US012404676B2

(12) United States Patent
Austin

(10) Patent No.: US 12,404,676 B2
(45) Date of Patent: Sep. 2, 2025

(54) LOW-PROFILE SKYLIGHT DEVICE

(71) Applicant: Douglas Austin, Oakman, AL (US)

(72) Inventor: Douglas Austin, Oakman, AL (US)

( * ) Notice: Subject to any disclaimer, the term of this patent is extended or adjusted under 35 U.S.C. 154(b) by 130 days.

(21) Appl. No.: 18/355,838

(22) Filed: Jul. 20, 2023

(65) Prior Publication Data

US 2024/0151037 A1 May 9, 2024

Related U.S. Application Data

(60) Provisional application No. 63/422,587, filed on Nov. 4, 2022.

(51) Int. Cl.
*E04D 13/03* (2006.01)

(52) U.S. Cl.
CPC ..... *E04D 13/031* (2013.01); *E04D 13/0315* (2013.01)

(58) Field of Classification Search
CPC ..... E04D 13/031; E04D 13/0305; E04D 13/0315
See application file for complete search history.

(56) References Cited

U.S. PATENT DOCUMENTS 4,468,899 A * 9/1984 Miller ..... E04D 13/031 52/204.593
4,649,680 A * 3/1987 Weisner ..... E04D 3/28 52/200
4,848,051 A * 7/1989 Weisner ..... E04D 13/031 52/200
4,860,511 A * 8/1989 Weisner ..... E04D 13/03 52/200
4,941,300 A * 7/1990 Lyons, Jr. ..... E04D 13/0315 52/72
5,044,133 A 9/1991 Sampson
5,099,622 A 3/1992 Sutton
8,833,010 B1 9/2014 Schlabach
9,920,532 B1 3/2018 Conklin
10,294,671 B2 * 5/2019 Sargent ..... E04D 13/0315
10,731,348 B2 * 8/2020 Sargent ..... E04D 13/0315
10,934,717 B2 * 3/2021 Atzen ..... E04D 1/36
11,162,264 B2 * 11/2021 Jorgenson ..... E04D 13/0315
2005/0055901 A1 3/2005 Valentz
2010/0132279 A1 * 6/2010 Valentz ..... E04D 13/031 29/897.3
2010/0139186 A1 * 6/2010 Laremore ..... E04D 13/0315 52/200
2024/0151037 A1 * 5/2024 Austin ..... E04D 13/0305

* cited by examiner

*Primary Examiner* — Andrew J Triggs
(74) *Attorney, Agent, or Firm* — Brennan, Manna & Diamond, LLC

(57) ABSTRACT

The present invention relates to a low-profile skylight device. A frame of the device receives a window, wherein the frame that extends no more than 0.25 inch above a roof structure. The frame is comprised of a flange that allows the frame to attach to a roof structure using at least one fastener placed through at least one opening of the flange and/or at least one adhesive on a bottom surface of the flange. The membrane is preferably comprised of a waterproof, single-ply membrane that can be attached around the frame and flange to the roof surface via an adhesive bottom surface.

5 Claims, 4 Drawing Sheets

LOW-PROFILE SKYLIGHT DEVICE

CROSS-REFERENCE TO RELATED APPLICATION

The present application claims priority to, and the benefit of, U.S. Provisional Application No. 63/422,587, which was filed on Nov. 4, 2022, and is incorporated herein by reference in its entirety.

FIELD OF THE INVENTION

The present invention relates generally to the field of skylights. More specifically, the present invention relates to a low-profile skylight device. A frame of the device receives a window, wherein the frame extends no more than 0.25 inch above a roof structure. The frame is comprised of a flange that allows the frame to attach to a roof structure using at least one fastener placed through at least one opening of the flange and/or at least one adhesive on a bottom surface of the flange. The membrane is preferably comprised of a waterproof, single-ply membrane that can be attached around the frame and flange to the roof surface via an adhesive bottom surface. Accordingly, the present disclosure makes specific reference thereto. Nonetheless, it is to be appreciated that aspects of the present invention are also equally applicable to other like applications, devices, and methods of manufacture.

BACKGROUND

Installing skylights can be a difficult and frustrating process. This is especially true because skylights pose a tripping hazard on a roof. This is due to skylights being installed with curbing that extends several inches above a roof surface. In addition, installing existing skylights known in the art is a time-intensive and difficult process that typically requires special training.

Therefore, there exists a long-felt need in the art for an improved skylight. There also exists a long-felt need in the art for a low-profile skylight device. More specifically, there exists a long-felt need in the art for a low-profile skylight device that prevents less of a tripping hazard than existing skylights known in the art. In addition, there exists a long-felt need in the art for a low-profile skylight device that can be easily installed. Further, there exists a long-felt need in the art for a low-profile skylight device that can be quickly installed without special/substantial training. Finally, there exists a long-felt need in the art for a low-profile skylight device that can be installed without curbing.

The subject matter disclosed and claimed herein, in one embodiment thereof, comprises a low-profile skylight primarily comprised of a frame comprised of at least one flange, at least one window, and at least one membrane. The frame is preferably comprised of a frame that extends no more than 0.25 inch above a roof structure. The frame receives the window, which is preferably made from a transparent safety glass. In addition, the flange allows the frame to attach to a roof structure using at least one fastener placed through at least one opening of the flange and/or at least one adhesive on a bottom surface of the flange. The membrane is preferably comprised of a waterproof, single-ply membrane that can be attached around the frame and flange to the roof surface via an adhesive bottom surface.

In this manner, the low-profile skylight device of the present invention accomplishes all the foregoing objectives and provides a low-profile skylight that prevents less of a tripping hazard than existing skylights known in the art. In addition, the device can be easily installed without special/substantial training. Finally, the device can be installed without curbing.

SUMMARY

The following presents a simplified summary to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a low-profile skylight. The device is primarily comprised of a frame comprised of at least one flange, at least one window, and at least one membrane. The frame of the device is preferably square or rectangular in shape. The frame is also preferably made from a corrosion-resistant metal material. The frame may be made of one continuous frame or a plurality of frame members that are attached together. The frame is preferably less than 0.25 inch in height to reduce the possibility of the device becoming a tripping hazard during roof construction/installation.

At least one window is positioned within the frame. In one embodiment the window is received by at least one waterproof gasket of the frame that prevents water from leaking through the space between the frame and window when installed in a structure. The window may be made from a plurality of material types. In one embodiment, the window is made from a transparent safety glass.

The frame can be attached to a roof structure during use using at least one flange. The flange may be comprised of at least one opening that allows at least one fastener to be inserted through the flange and secured to the structure. The fastener may be any type such as, but not limited to, a screw, a bolt, etc.

In one embodiment, the bottom surface of the flange may additionally or alternatively be comprised of at least one adhesive. The adhesive allows the flange to further attach to a roof structure. One embodiment of the flange may not have any openings and may only have the adhesive.

The frame is further secured to a roof structure via at least one membrane. The membrane is preferably a single-ply membrane that is waterproof to prevent water from penetrating the frame. The bottom surface of the membrane may be comprised of at least one adhesive that allows the membrane to further attach to a roof structure.

The device is also comprised of a method of using the device. First, a low-profile skylight device is provided comprising a frame, a window, and a membrane. Next, the frame is secured to a roof structure by placing at least one fastener through at least one opening in the flange and/or via at least one adhesive on a bottom surface of the flange. After the frame has been secured, at least one membrane can be placed around the frame and attached to the roof surface to create a waterproof seal around the frame.

Accordingly, the low-profile skylight device of the present invention is particularly advantageous as it provides a low-profile skylight that prevents less of a tripping hazard than existing skylights known in the art. In addition, the device can be easily installed without special/substantial training. Finally, the device can be installed without curbing. In this manner, the low-profile skylight device overcomes the limitations of existing skylights known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
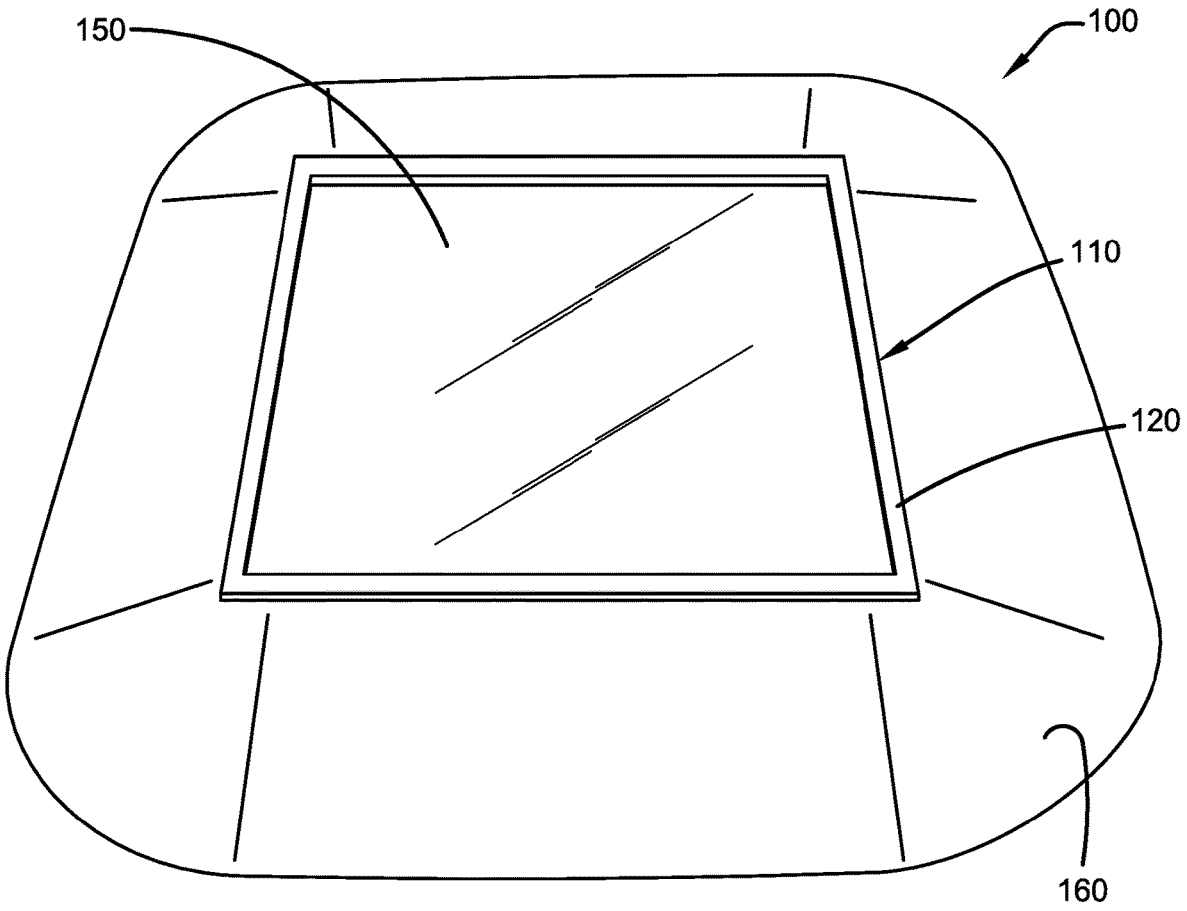
FIG. 1 illustrates a top view of one potential embodiment of a low-profile skylight device of the present invention in accordance with the disclosed architecture.

The innovation is now described with reference to the drawings, wherein like reference numerals are used to refer to like elements throughout. In the following description, for purposes of explanation, numerous specific details are set forth to provide a thorough understanding thereof. It may be evident, however, that the innovation can be practiced without these specific details. In other instances, well-known structures and devices are shown in block diagram form to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for an improved skylight. There also exists a long-felt need in the art for a low-profile skylight device. More specifically, there exists a long-felt need in the art for a low-profile skylight device that prevents less of a tripping hazard than existing skylights known in the art. In addition, there exists a long-felt need in the art for a low-profile skylight device that can be easily installed. Further, there exists a long-felt need in the art for a low-profile skylight device that can be quickly installed without special/substantial training. Finally, there exists a long-felt need in the art for a low-profile skylight device that can be installed without curbing.

The present invention, in one exemplary embodiment, is comprised of a low-profile skylight device. The device is primarily comprised of a frame, comprised of at least one flange, at least one window, and at least one membrane. The frame of the device is preferably square or rectangular in shape and is preferably made from a corrosion-resistant metal material. The frame may be made of one continuous frame or a plurality of frame members that are attached together. The frame is preferably less than 0.25 inch in height to reduce the possibility of the device becoming a tripping hazard during roof construction/installation.

Furthermore, at least one window is positioned within the frame. In one embodiment the window is received by at least one waterproof gasket of the frame that prevents water from leaking through the space between the frame and window when installed in a structure. The window may be made from a plurality of material types. In one embodiment, the window is made from a transparent safety glass.

The frame can be attached to a roof structure during use using at least one flange. The flange may be comprised of at least one opening that allows at least one fastener to be inserted through the flange and secured to the structure. The fastener may be any type such as, but not limited to, a screw, a bolt, etc. In one embodiment, the bottom surface of the flange may additionally or alternatively be comprised of at least one adhesive. The adhesive allows the flange to further attach to a roof structure. One embodiment of the flange may not have any openings and may only have the adhesive.

The frame is further secured to a roof structure via at least one membrane. The membrane is preferably a single-ply membrane that is waterproof to prevent water from penetrating the frame. The bottom surface of the membrane may be comprised of at least one adhesive that allows the membrane to further attach to a roof structure.

The device is also comprised of a method of using the device. First, a low-profile skylight device is provided comprising a frame, a window, and a membrane. Next, the frame is secured to a roof structure by placing at least one fastener through at least one opening in the flange and/or via at least one adhesive on a bottom surface of the flange. After the frame has been secured, at least one membrane can be placed around the frame and attached to the roof surface to create a waterproof seal around the frame.

Accordingly, the low-profile skylight device of the present invention is particularly advantageous as it provides a low-profile skylight that prevents less of a tripping hazard than existing skylights known in the art. In addition, the device can be easily installed without special/substantial training. Finally, the device can be installed without curbing. In this manner, the low-profile skylight device overcomes the limitations of existing skylights known in the art.

Referring initially to the drawings, FIG. 1 illustrates a top view of one potential embodiment of a low-profile skylight device 100 of the present invention in accordance with the disclosed architecture. The device 100 is primarily comprised of a frame 110, comprised of at least one flange 130, at least one window 150, and at least one membrane 160. The frame 110 of the device 100 is preferably square or rectangular in shape. However, the frame 110 may be any shape known in the art. The frame 110 is preferably made from a corrosion-resistant metal material such as, but not limited to, stainless steel or aluminum. The frame 110 may be any color known in the art to blend into a roofline. The frame 110 may be made of one continuous frame or a plurality of frame members 120 that are attached together. The frame members 120 may be attached via welds or removable/fixed fasteners.

At least one window 150 is positioned within the frame 110. More specifically, in one embodiment the window 150 is received by at least one waterproof gasket 122 of the frame 120. The gasket 122 prevents water from leaking through the space between the frame 110 and window 150 when installed in a structure.

The window 150 may be made from a plurality of material types. In one embodiment, the window 150 is made from a transparent safety glass. However, the window 150 may be made from any material known in the art. In addition, one embodiment of the window 150 may be comprised of a tinted window to reduce sunlight transmission through the window 150.

Figure 2:
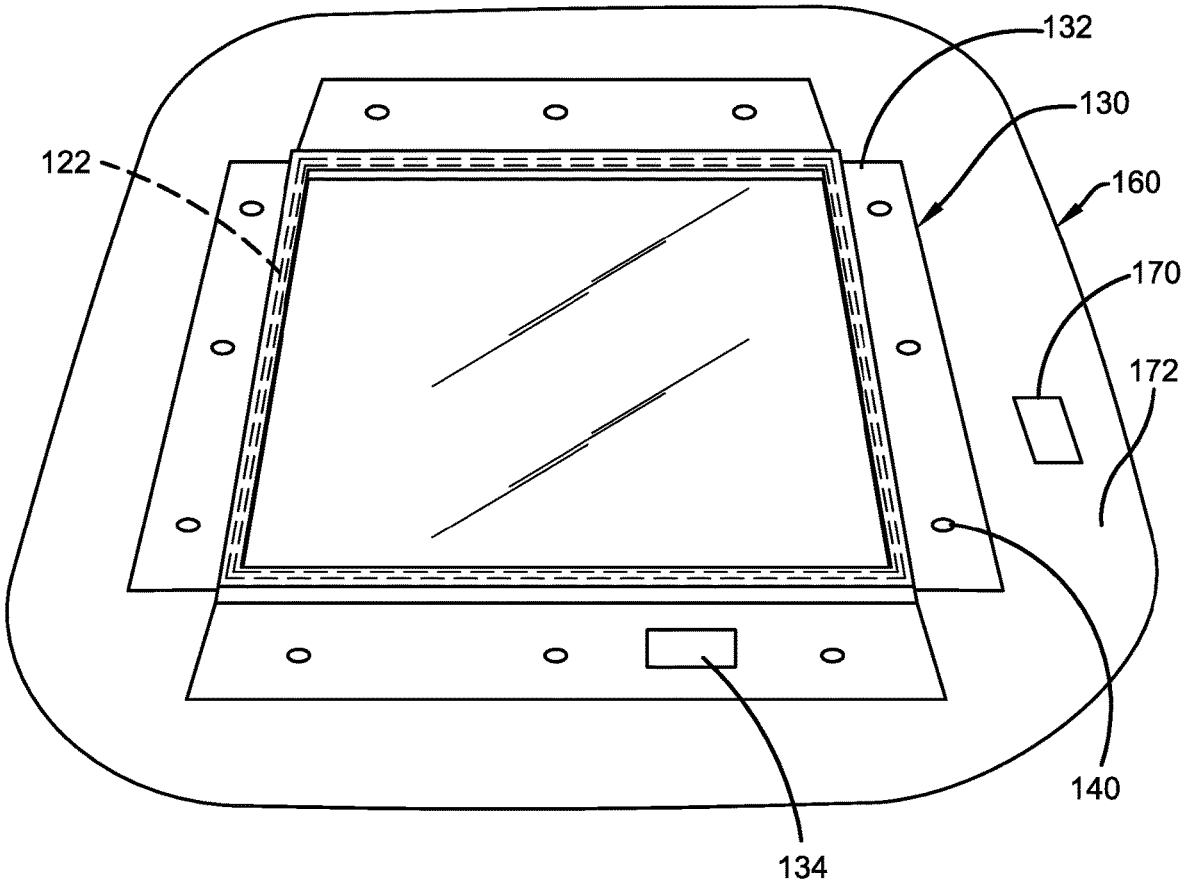
FIG. 2 illustrates a bottom view of one potential embodiment of a low-profile skylight device of the present invention in accordance with the disclosed architecture.
Figure 3:
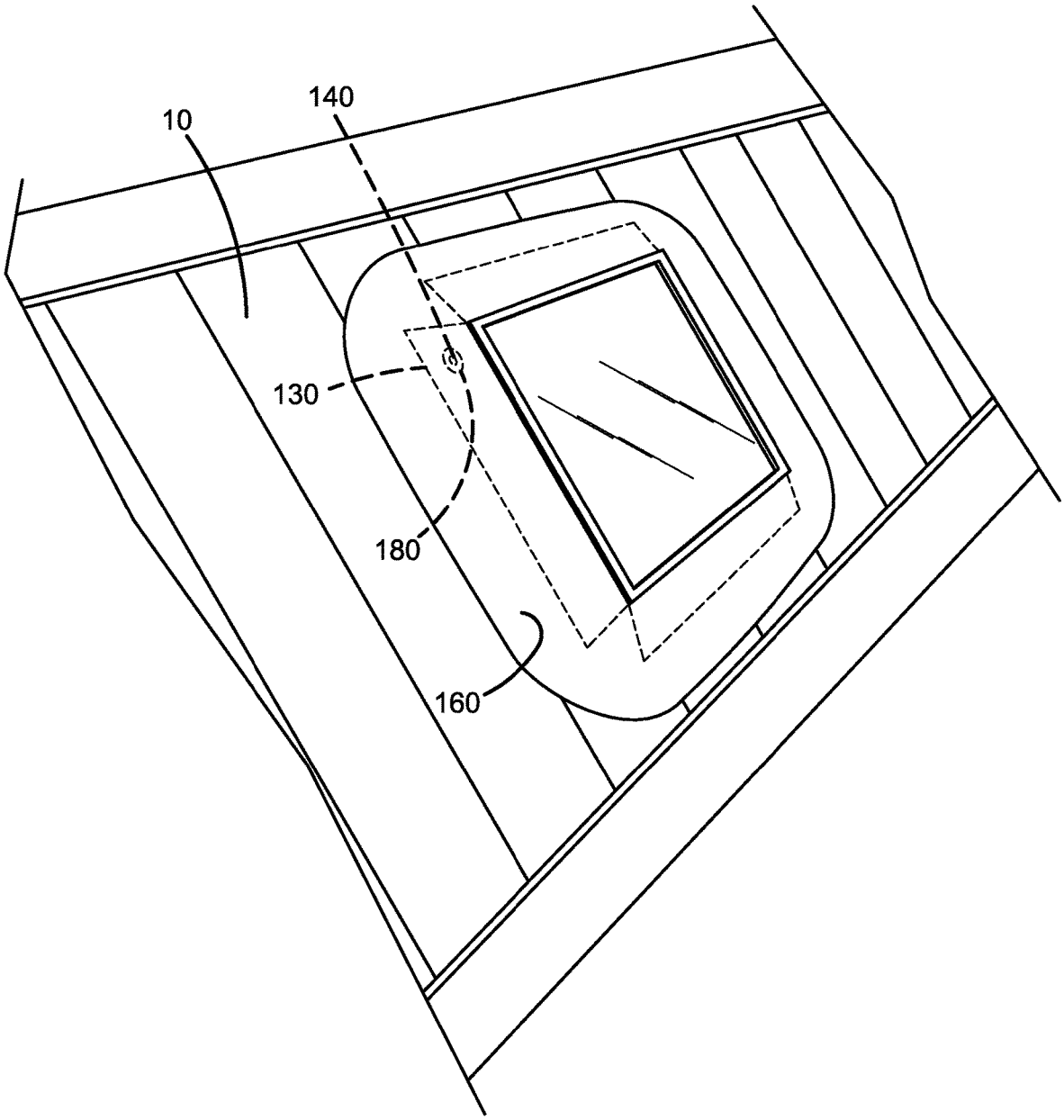
FIG. 3 illustrates a perspective view of one potential embodiment of a low-profile skylight device of the present invention while attached to a roof structure in accordance with the disclosed architecture.

The frame 110 can be attached to a roof structure 10 during use. More specifically, each frame member 120 may be comprised of at least one flange 130, as seen in FIG. 2 and FIG. 3. The flange 130 is preferably made from the same material as the frame 110. The flange 130 is also comprised of at least one opening 140 that allows at least one fastener 180 to be inserted through the flange 130 and secured to the structure 10. The fastener 180 may be any type such as, but not limited to, a screw, a bolt, etc. In one embodiment, the flange 130 may be made from a flexible material that allows the flange 130 to be easily bent to the slope and/or shape of a roof structure 10.

In one embodiment, the bottom surface 142 of the flange 130 may additionally or alternatively be comprised of at least one adhesive 134. The adhesive 134 allows the flange 130 to further attach to a roof structure 10. One embodiment of the flange 130 may not have any openings 140 and may only have the adhesive 134.

The frame 110 is further secured to a roof structure 10 via at least one membrane 160, as seen in FIG. 3. The membrane is preferably a single-ply membrane, but may be any membrane known in the art. The membrane 160 is preferably a waterproof membrane to prevent water from penetrating the frame 110. The bottom surface 170 of the membrane 160 may be comprised of at least one adhesive 172. The adhesive 72 allows the membrane 160 to further attach to a roof structure 10. The adhesives 134,172 of the device 100 may be any roofing or other related adhesive known in the art. It should be noted that the membrane 160 allows roofing materials such as, but not limited to, shingles or metal roofing to be easily installed over the membrane 160.

The frame 110 is preferably less than 0.25 inch in height. This reduces the possibility of the device 100 becoming a tripping hazard during roof construction/installation. The frame 110 is preferably flush with the membrane 160 and tapers to match the roof surface 10.

Figure 4:
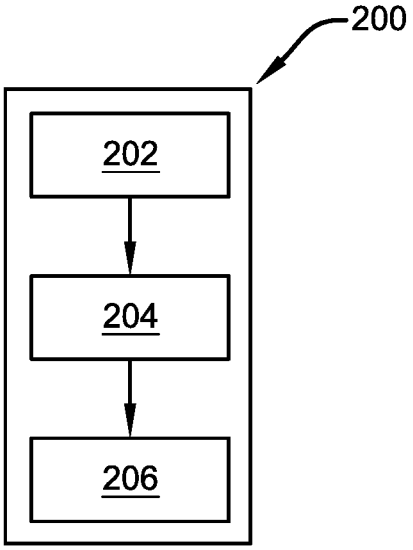
FIG. 4 illustrates a flowchart of a method of using one potential embodiment of a low-profile skylight device of the present invention in accordance with the disclosed architecture.

FIG. 4 illustrates a flowchart of a method of using 200 one potential embodiment of a low-profile skylight device 100 of the present invention in accordance with the disclosed architecture. The device 100 is also comprised of a method of using 200 the device 100. First, a low-profile skylight device 100 is provided, the device 100 is comprised of a frame 110, a window 150, and a membrane 160 [Step 202]. Next, the frame 110 is secured to a roof structure 10 by placing at least one fastener 180 through at least one opening 140 in the flange 130 and/or via at least one adhesive 132 on a bottom surface of the flange 130 [Step 204]. After the frame 110 has been secured, at least one membrane 160 can be placed around the frame 110 and attached to the roof surface 10 to create a waterproof seal around the frame 110 [Step 206].

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "low-profile skylight device" and "device" are interchangeable and refer to the low-profile skylight device 100 of the present invention.

Notwithstanding the foregoing, the low-profile skylight device 100 of the present invention and its various components can be of any suitable size and configuration as is known in the art without affecting the overall concept of the invention, provided that they accomplish the above-stated objectives. One of ordinary skill in the art will appreciate that the size, configuration, and material of the low-profile skylight device 100 as shown in the FIGS. are for illustrative purposes only, and that many other sizes and shapes of the low-profile skylight device 100 are well within the scope of the present disclosure. Although the dimensions of the low-profile skylight device 100 are important design parameters for user convenience, the low-profile skylight device 100 may be of any size, shape, and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A skylight device comprising:

a frame comprised of a flange;

a window; and a membrane; and wherein the frame is less than 0.25 inches in height, is flush with the membrane, and tapers to match a surface of a roof;

wherein the flange is a flexible flange configured to bend to match the surface of the roof; and wherein the window is a tinted safety glass window.

2. A skylight device of claim 1, wherein a first bottom surface of the flange is comprised of a first adhesive.

3. A skylight device of claim 2, wherein a first bottom surface of the membrane is comprised of a second adhesive.

4. A skylight device of claim 1, wherein the frame is comprised of a square frame.

5. A skylight device of claim 1, wherein the frame is comprised of a corrosion-resistant metal material.

* * * * *